United States Patent [19]

Mayer

[11] Patent Number: 4,840,103

[45] Date of Patent: Jun. 20, 1989

[54] STRING LOCK FOR ACOUSTICAL INSTRUMENTS

[76] Inventor: Todd Mayer, 309 B. Woodcreek Rd., Apt. 215, Bollingbrook, Ill. 60439

[21] Appl. No.: 59,588

[22] Filed: Jun. 8, 1987

[51] Int. Cl.[4] ..... G10D 3/12

[52] U.S. Cl. ..... 84/297 R; 84/291; 84/307

[58] Field of Search ..... 84/267, 291, 297 R, 84/298, 299, 307

[56] References Cited

U.S. PATENT DOCUMENTS

| | | | |
|---|---|---|---|
| 418,364 | 12/1889 | Bookser | 84/297 R |
| 617,915 | 1/1899 | Wells | 84/297 R |
| 976,428 | 11/1910 | Benson et al. | 84/298 |
| 1,368,818 | 2/1921 | Martin | 24/701 |
| 1,764,679 | 6/1930 | Gast | 84/298 |
| 2,029,135 | 1/1936 | Stanley | 84/298 |
| 2,573,254 | 10/1951 | Fender | 84/1.16 |
| 4,041,830 | 8/1977 | Doane | 84/305 |
| 4,230,014 | 10/1980 | Hoshino | 84/299 |
| 4,341,144 | 7/1982 | Milne | 84/307 |
| 4,377,963 | 3/1983 | Siminoff | 84/297 R |
| 4,383,466 | 5/1983 | Shibuya | 84/313 |
| 4,453,443 | 6/1984 | Smith | 84/298 |
| 4,506,585 | 3/1985 | Desmond | 84/298 |
| 4,572,049 | 2/1986 | Tanaka | 84/313 |
| 4,608,905 | 9/1986 | Takabayashi | 84/313 |
| 4,608,906 | 9/1986 | Takabayashi | 84/313 |

*Primary Examiner*—Lawrence R. Franklin

*Attorney, Agent, or Firm*—Neuman, Williams, Anderson & Olson

[57] ABSTRACT

An improved device for fixing the strings of an acoustical stringed instrument including a generally rectangular block, preferably composed of a metal such as aluminum or bronze, having a bottom surface, upwardly extending wall surfaces and a top surface. The block is provided with a bore extending from the block's top surface to the bottom surface. The bore is in a generally normal relation to the block's top surface and is provided with a notch extending from the top surface to the bottom surface of the block. The block's bottom surface, in addition, is provided with a generally circular depression centered approximately over the midpoint of the notch opening at the bottom surface.

The block is positioned in the interior of an acoustical stringed instrument so that the bore is operatively aligned beneath the opening in the bridge of the instrument designed to receive the end of a string having a restraining means at the string's terminus. The string end is passed through the hole in the bridge, through the bore of the block, and into the interior of the instrument. When tension is applied to the string, the end of the string moves into the notch in the bore, and the restraining means engages the depression on the bottom surface of the block, fixing the string in place.

7 Claims, 1 Drawing Sheet

FIG. 5
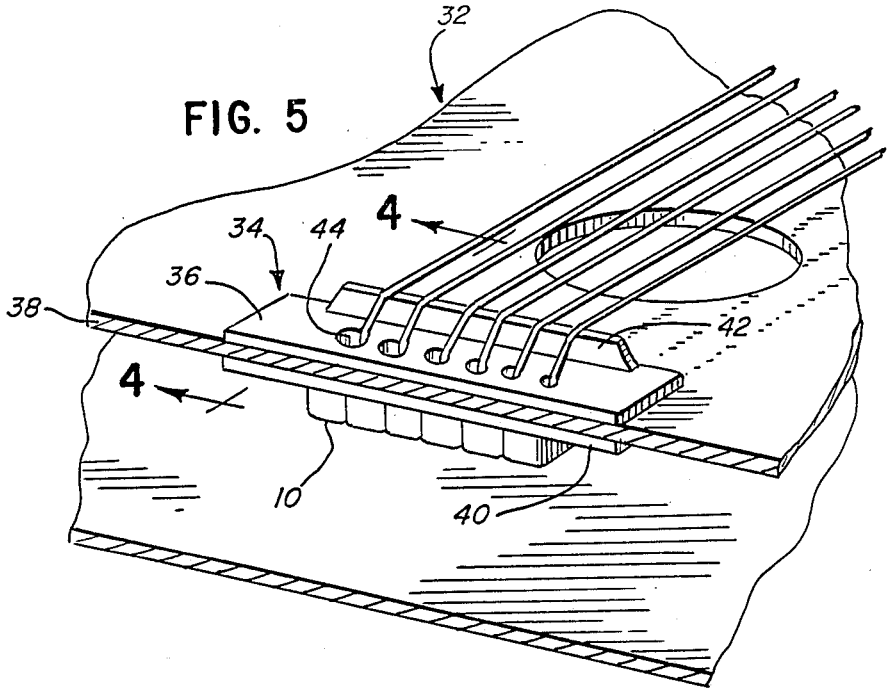
FIG. 4
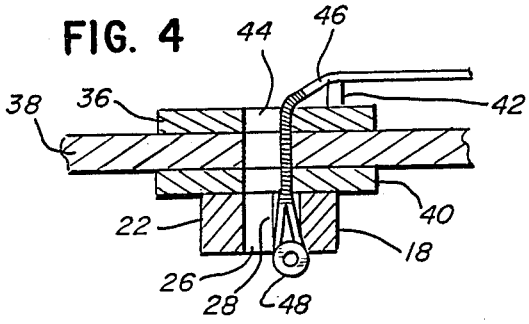
FIG. 1
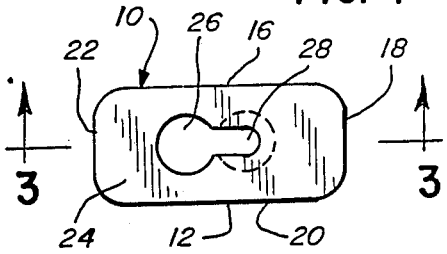
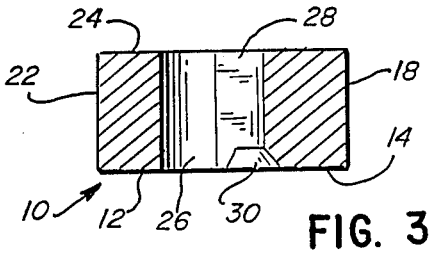
FIG. 3
FIG. 6
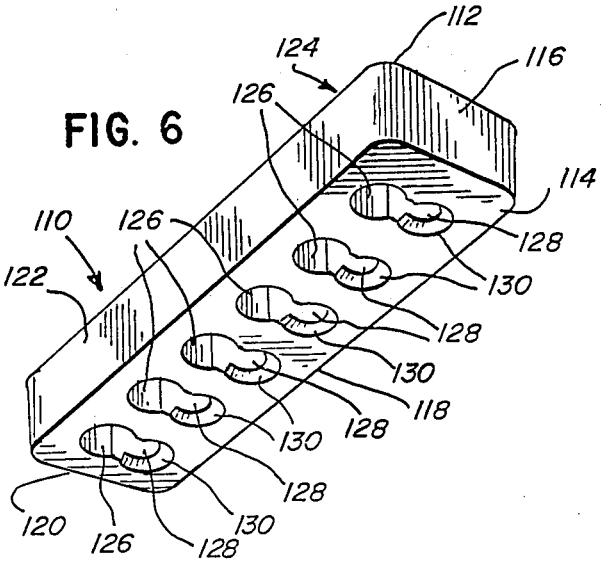
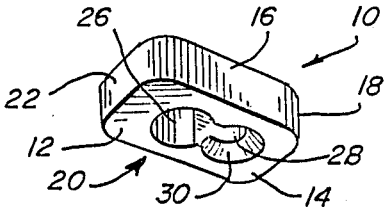
FIG. 2

STRING LOCK FOR ACOUSTICAL INSTRUMENTS

BACKGROUND OF THE INVENTION

In most stringed instruments such as six and twelve string guitars, mandolins, lutes and the like, the strings of the instrument are fixed or held in place at two points. One end of each string is fixed at the head of the instruments by a tuning peg and the other end is fixed at the bridge on the instrument's body. This invention relates to an improvement in the apparatus for fixing or holding strings in place at the bridge of acoustical stringed instruments such as acoustical guitars, mandolins, lutes or similar instruments relying primarily on non-electric means for producing sound.

Several methods have previously been used for securing strings at the bridge of an acoustical instrument. The most common method is to provide an opening in the bridge of the instrument through which a string may be inserted and locked into place with a retaining peg. Often the strings of the instrument are provided with restraining means in the form of a ball or barrel located at the terminus of the string to simplify locking the string in place. In many instruments, the opening in the bridge is further provided with a small notch to allow room for the diameter of the string when the retaining peg is in position.

For example, in acoustical guitars such as shown in Siminoff, U.S. Pat. No. 4,377,963, the end of each string is provided with a restraining means and is inserted through an opening in the bridge of the guitar into the interior of the instrument. A peg is then inserted into the bridge opening and is lodged tightly in place to prevent the restraining means from slipping back through the opening when tension is applied to the string. A similar arrangement is used in other acoustical instruments such as mandolins, lutes and the like.

The use of a peg, however, for fixing the strings of an acoutical instrument creates several problems. During installation of the strings, the force required to securely wedge a peg into the instrument's bridge opening may damage the instrument's body or bridge assembly. In turn, attempts to remove the tightly wedged pegs may also damage the instrument. These difficulties are of particular concern to owners of rare or expensive instruments as the bridges and bodies of such instruments may be especially vulnerable to injury and damage.

In addition, removing pegs from a bridge assembly can be very difficult and time consuming, and may require special tools. Moreover, once the prior art pegging apparatus is installed on acoustical stringed instruments, it is very difficult, if not impossible, to change to other prior art string fixing devices.

Furthermore, when an acoustical instrument's strings are under tension, the prior art apparatus allow the strings to exert considerable stress on the upper portion of the bridge assembly. Often this upper portion of the bridge is simply glued to the body of the instrument, and with time, the upper portion of the bridge may separate from the instrument's body as a result of the stress from the strings. This is true of the prior art peg systems, as well as other apparatus that fix the strings primarily on the upper portion of the bridge.

In addition to the above considerations, attempts have been made to modify the prior art string fixing systems and bridge assemblies to improve the sound of acoustical instruments by prolonging the duration of notes or tones produced by the instrument's strings. For example, metallic retaining pegs have been used to fix the strings of the instruments, and weights and the like have been added to the bridges of the instruments.

It has been found that while these prior art assemblies may prolong the duration of the notes or tones produced by the strings, they also cause a serious deterioration in the quality of the instrument's sound. Thus, for most applications, the prior art methods for improving the sound of acoustical instruments are unacceptable.

Other prior art apparatus concerning fixing the strings of guitars include those disclosed in Takabayashi, U.S. Pat. No. 4,608,905, Takabayashi, U.S. Pat. No, 4,608,906, Tanaka et. al., U.S. Pat. No. 4,572,049, Desmond U.S. Pat. No. 4,506,585, Smith, U.S. Pat. No. 4,453,443, Shibuya, U.S. Pat. No. 4,383,466, Milne, U.S. Pat. No, 4,341,144, Hoshino, U.S. Pat. No. 4,230,014, Fender, U.S. Pat. No. 2,573,254, Stanley et al., U.S. Pat. 2,029,135, and Martin, U.S. Pat. No. 1,368,818. These references do not suggest a device for use on acoustical stringed instruments that is less complicated or difficult to use than the prior art pegging system, nor do they teach a means for fixing the strings of an acoustical instrument that avoids stressing the upper portion of the bridge of the instruments.

The above references, in addition, do not suggest means for prolonging the sound produced by the strings of acoustical instruments without adversely affecting the quality of the tones or notes. Nor can the apparatus of these references be converted to use any other string fixing system.

OBJECTS OF THE INVENTION

The object of the invention is to provide a simple and inexpensive means for fixing or holding the strings of an acoustical stringed instrument, such as an acoustical guitar, mandolin, lute and the like, at the bridge of the instrument. This is done without the use of pegs or similar apparatus.

Another object of the invention is to prevent the exertion of deleterious stress on the bridge of the instrument.

It is a further object of the invention to provide a string fixing device that enhances the sound of an acoustical stringed instrument without adversely affecting the quality of sound of the instrument.

It is a still further object of the invention to provide a device for fixing the strings of an acoustical stringed instrument that may be incorporated in new instruments or may be easily adapted for use on existing instruments.

Yet another object of the invention is to provide a string fixing device that will allow for the simple conversion or retrofitting of instruments using the invention to other prior art string fixing systems.

Further additional objects will appear from the description, accompanying drawings, and appended claims.

SUMMARY OF THE INVENTION

The preferred embodiment of the improved device for fixing the strings of an acoustical stringed instrument includes a generally rectangular block, preferably composed of a metal such as aluminum or bronze, having a bottom surface, upwardly extending wall surfaces and a top surface. The block is provided with a bore extending from the block's top surface to the bottom surface. The bore is in a generally normal relation to the block's top surface and is provided with a notch extending from the top surface to the bottom surface of the block. The block's bottom surface is further provided with a generally circular depression centered approximately over the mid-point of the notch opening at the bottom surface.

The block is positioned in the interior of an acoustical stringed instrument so that the bore is operatively aligned beneath the opening in the bridge of the instrument designed to receive the end of a string having a restraining means at the string's terminus (usually a ball or barrel member). The string end is passed through the hole in the bridge, through the bore of the block, and into the interior of the instrument. When tension is applied to the string, the end of the string moves into the notch in the bore, and the restraining means engages the depression on the bottom surface of the block, fixing the string in place.

BRIEF DESCRIPTION OF THE DRAWINGS

For a more complete understanding of the invention, reference should be made to the drawings wherein:

FIG. 1 is a top view of one form of the string lock for acoustical instruments.

FIG. 2 is a perspective bottom view of one form of the spring lock for acoustical instruments.

FIG. 3 is a cross-sectional side view of one form of the string lock for acoustical instruments.

FIG. 4 is a cross-sectional side view of the string lock for acoustical instruments positioned in the interior of an acoustical instrument, below the bridge of the instrument, and in operative engagement with a string of the instrument.

FIG. 5 is a perspective view of a plurality of one form of a string lock for acoustical instruments installed in a six string acoustical guitar and operatively engaged with the strings of the guitar.

FIG. 6 is a perspective bottom view of the string lock for acoustical instruments in the form of a unitary assembly for fixing a plurality of strings.

DETAILED DESCRIPTION OF THE PREFERRED EMBODIMENT

Referring now to the drawing and more particularly to FIG. 1, FIG. 2, and FIG. 3, a preferred embodiment of the string lock for acoustical instruments is shown as used (for the purpose of illustration) with a six string acoustical guitar. The string lock 10 includes a block 12 preferably made of a metal such as aluminum or bronze, but the block may also be composed of other metals or durable materials such as wood, plastic and the like. The block 12 is shaped generally in the form of a rectangle having a bottom surface 14, upwardly extending wall surfaces 16, 18, 20, and 22, and a top surface 24. The corners of the preferred embodiment may be rounded for convenient placement in the instrument. The block may also be formed so that it has a generally elliptical, polygonal or cubic shape in cross-section (among others) depending on the size of the instrument and the space available in the interior of the instrument.

The block 12 has formed therein a bore 26, preferably extending from the top surface 24 of the block to the bottom surface 14, and the bore is disposed generally in a normal relation to the top surface 24. The bore should be sufficiently large so that, as shown in FIG. 4 (discussed below), the restraining means 48 located at the end of the instrument string 46 may pass through the bore 26.

A notch 28 is formed in the bore 26 that extends the entire length of the bore so that the preferred embodiment, when viewed in cross-section, has the appearance of a key hole shape. The notch 28 is sized to accept a variety of strings with differing diameters, and is large enough to accept the thickest string used on the instrument. The notch, in addition, is sized so that the restraining means 48 at the end of the string 46 (shown in FIG. 4) cannot pass through the notch.

In the preferred embodiment, a generally circular depression 30 is formed on the bottom surface 14 of the block and is centered approximately over the midpoint of the notch opening on the bottom surface 14 of the block. This depression need not be circular, but should be sized so that the restraining means 48 located at the end of the instrument string 46 will lodge in the depression.

As shown in FIGS. 4 and 5, the string lock 10 is placed in the interior of an acoustical string instrument 32 (in the drawings, a guitar) having a bridge 34. The bridge comprises an upper portion 36 attached to the sounding board 38 of the instrument, a lower reinforcing portion 40 and a string support member 42. The upper portion 36 and lower portion 40 of the bridge are usually attached to the sounding board 38 by glue, screws or similar fastening means.

Normally, an opening 44 is formed in the bridge 34 of the instrument to allow the passage of each string 46 of the instrument through the bridge into the interior of the instrument. The strings 46 have a restraining means 48 located at their terminus that is usually a ball or barrel shaped member, but may also include a knot tied in the string or similar restraining means. In instruments adapted for use with the prior art peg fixing apparatus, the opening 44 may also be provided with a notch to allow space for the string 46 when the pegs are in position.

In the preferred embodiment, the string lock 10 is positioned beneath the bridge 34 of the instrument and the bore 26 is aligned with the bridge opening 44 so that the string 46 and restraining means 48 can pass through the opening in the bridge and the bore 26 of the string lock into the interior of the instrument. When tension is applied to the string 46, the string will move into the notch 28 and the restraining means 48 will be drawn up into the circular depression 30 to engage the bottom surface of the block 14 fixing the string in place. To facilitate the placement of the restraining means 48 into the circular depression 30, the string 46 may be inserted through the bridge opening 44 and bore 25 at an angle.

The invention, in addition, can be practiced without the depression 30. In this embodiment, the restraining means 48 at the end of the string 46 will simply lodge against the bottom surface of the block surrounding the notch 28.

The string lock may be held in place in the interior of the guitar by the compressive force exerted by the string and the restraining means on the bottom surface 14 of the block. In the preferred embodiment, glue, double sided tape or the like is also applied to the top surface 24 of the block to hold the string and lock in place and other alternative fastening means may be used as well.

While the preferred embodiment of the string lock is described in terms of individual locks for each string of the instrument, the invention may also take the form of a unitary assembly fixing or holding a plurality of strings. Such an assembly may be in the shape of a bar or large block provided with a plurality of bores and may be custom designed for particular instruments. The unitary assembly, alternatively, may be integrally formed in the lower portion of the bridge 40 to reduce the number of parts necessary to practice the invention. Thus, the unitary form of the invention makes the manufacture of acoustical instruments using the invention more convenient and economical.

For example, a unitary assembly for fixing a plurality of strings 110 is shown in FIG. 6. In this embodiment, the invention includes a block 112 formed generally in the shape of a rectangule, having a bottom surface 114, upwardly extending wall surfaces 116, 118, 120 and 122, and a top surface 124. The block has a plurality of bores 126 formed therein, extending from the top surface 124 of the block to the bottom surface 114. A notch 128 is formed in each bore, giving each bore the appearance of a keyhole. In the preferred embodiment, a generally circular depression 130 is formed on the bottom surface 114 of the block over the notch 128 in each bore.

As with the previously described embodiment, the unitary assembly 110 is mounted in the interior of the acoustical stringed instrument with glue or tape applied to the top surface of the assembly 124 and is positioned in an operative relation to the plurality of openings in the bridge of the instrument. When tension is applied to strings inserted into the assembly, means on each of the strings moves into its respective notch 128 and the restraining means on the strings lodge in circular depression 130, fixing the strings in place.

As can be seen from the description above, the string lock may be easily installed in existing acoustical stringed instruments or may be incorporated into the manufacture of new acoustical instruments. Virtually no significant modifications of the instruments are necessary to use the invention. One need only place the string locks in the instruments and abandon the use of other prior art apparatus, such as pegs. Moreover, changing from the invention to other methods of fixing the strings of acoustical instruments is simple and convenient. The string locks may just be detached from the underside of the bridge and removed from the instrument. Once removed, the string lock may also be reused a number of times.

Installing and changing strings on acoustical stringed instruments using the invention is substantially faster and more convenient than with the prior art. It is no longer necessary to tightly lodge pegs into the bridge openings or to struggle to dislodge the pegs without injuring the instrument. This features is of particular importance to performing artists who may break or damage a string in the midst of a performance.

Those owning rare or expensive instruments can avoid irreparable injury to their instruments during the installation and changing of its strings by using the invention. Specialized tools needed to extract the prior art pegs are also unnecessary when the invention is used. In addition, the simple construction of the invention makes it inexpensive and durable.

More importantly, the location of the string lock beneath the bridge of the instrument and the invention's unique construction has produced several unexpected results. The most apparent unexpected result is the enhancement of tones or notes produced by strings fixed in place with the invention. For example, the duration of the tones or notes is significantly prolonged without discernable deterioration in the quality of the instrument's sound. While such an effect had been sought in the past, the prior art attempts have been unsuccessful.

It is believed that this effect may be due to the nature and placement of the string lock. The string lock appears to effectively increase the mass of the sounding board and, at the same time, transfer the vibrational energy of the string to the sounding board with little loss in strength or quality.

The placement and structure of the string lock, in addition, exerts positive compressive force on the bridge members, especially the top and bottom portions of the bridge. Thus, in contrast to the destructive effects of the prior art, the invention acts to urge each element of the bridge assembly together and greatly reduces harmful stresses on the top portion of the bridge. Accordingly, the quality of the sound of the instrument is preserved and the life of the instrument is substantially increased.

Furthermore, it is believed that the string lock acts positively on the strings of the instrument. It has been observed that strings held in place by the invention appear to last longer and suffer less wear and tear than with the prior art devices.

Thus, it will be seen that a simple and inexpensive string lock has been provided that may easily be used with acoustical stringed instruments. The invention has the unexpected properties of improving the sound of the instrument and substantially reduces destructive stress on the bridge of the instrument.

While the application has shown the preferred embodiment and certain alternative embodiments of the invention, one will understand of course that the invention is not limited to these embodiments since those skilled in the art to which the invention pertains may make modifications and other embodiments of the principles of this invention, particularly upon considering the foregoing teachings. The applicant, therefore, by the appended claims, intends to cover any modifications and other embodiments as to incorporate those features which constitute the essential features of this invention.

What is claimed is:

1. A string retention system for a hollow bodied musical instrument having a soundboard, the improvement comprising:

a bridge including a string support member fixed to the exterior surface of said soundboard;

a reinforcing means fixed to the interior surface of said soundboard beneath said bridge;

a plurality of strings, each string having an appropriate diameter throughout its length and having a restraining means at one end, the diameter of said restraining means being substantially greater than said string length diameter;

a plurality of bores, the number of which equals the number of said plurality of strings, each of said bores being keyhole shaped and extending linearly through said bridge, said soundboard, and said reinforcing means, the circular portion of said keyhole shape being sufficiently large such that said restraining means can pass therethrough and the notched portion of said keyhole shape having a width larger than said string length diameter and smaller than said restraining means diameter; and a plurality of string locks, one for each string, each of said string locks consisting of a block having a top surface, a generally parallel bottom surface, and side walls extending between said top and botom surfaces, a bore extending through said block from said top surface to said bottom surface, said bore having a keyhole shape of substantially the same size and shape of each of said plurality of bores, a depression formed in the bottom surface of said string lock approximately over the midpoint of the notch of said string lock keyhole;

each string lock being positioned interiorly of said hollow body with its bore aligned with an associated one of said plurality of bores, an associated one of said plurality of strings having its restraining means passed through the aligned circular portions of said bores and seated in said string lock depression, thereby extending the adjacent portion of said string length through the notched portion of said aligned bores and over said string support member, whereby the tension of the string provides a compressive force on the combination of elements consisting of said string lock, said reinforcing means, said soundboard, and said bridge which fixes the string in place.

2. The system of claim 1 wherein said block is generally eliptical in cross-section parallel to the planes defined by the top and bottom surfaces of said block.

3. The system of claim 1 wherein the top surface of said block is provided with means for attaching said block in the interior of the instrument's body, beneath the bridge of the instrument.

4. The system of claim 3 wherein the means for attaching said block to the interior of the instrument comprises an adhesive or an adhesive tape.

5. The system of claim 1 wherein said block is generally polygonal in cross-section parallel to the planes defined by the top and bottom surfaces of said block.

6. The system of claim 1 wherein said block is metallic.

7. The system of claim 1 wherein said block is made of a wooden or synthetic plastic material.

* * * * *